US005494464A

United States Patent [19]

Kobayashi et al.

[11] Patent Number: 5,494,464

[45] Date of Patent: Feb. 27, 1996

[54] CONTROL FOR JET POWERED WATERCRAFT

[75] Inventors: Noboru Kobayashi; Tomoyoshi Koyanagi, both of Iwata, Japan

[73] Assignee: Yamaha Hatsudoki Kabushiki Kaisha, Iwata, Japan

[21] Appl. No.: 261,761

[22] Filed: Jun. 17, 1994

Related U.S. Application Data

[63] Continuation of Ser. No. 977,127, Nov. 16, 1992, abandoned.

[51] Int. Cl.[6] ..... B63H 11/11

[52] U.S. Cl. ..... 440/41; 440/84; 440/86

[58] Field of Search ..... 440/40, 41, 42, 440/84, 86; 114/53, 270; 74/478, 478.5, 474; 239/265.29

[56] References Cited

U.S. PATENT DOCUMENTS

| | | | |
|---|---|---|---|
| 2,867,132 | 1/1959 | Schroeder | 440/86 |
| 3,003,455 | 10/1961 | Alexander et al. | 440/42 |
| 3,020,872 | 2/1962 | Gierczic | 440/42 |
| 3,105,353 | 10/1963 | Schulz | 440/41 |
| 4,064,823 | 12/1977 | Draxler | 440/55 |
| 4,084,536 | 4/1978 | Stansbury | 440/85 |
| 4,708,671 | 11/1987 | Watanabe | 440/41 |
| 4,753,618 | 6/1988 | Entringer | 440/84 |
| 4,801,282 | 1/1989 | Ogawa et al. | 440/84 |
| 4,964,821 | 10/1990 | Tafoya | 440/41 |
| 5,062,815 | 11/1991 | Kobayashi | 440/41 |
| 5,154,650 | 10/1992 | Nakase | 440/40 |

*Primary Examiner*—Margaret A. Focarino
*Assistant Examiner*—Thomas J. Brahan
*Attorney, Agent, or Firm*—Knobbe, Martens, Olson & Bear

[57] ABSTRACT

A watercraft powered by a pair of jet propulsion units each having reverse thrust buckets that are controlled by pedals positioned in the operator's compartment. The pedal control is such that both reverse thrust buckets can be operated by a single foot of the operator for reverse thrust operation and braking or so that each pedal may be operated independently for abrupt turning maneuvers. An interlock system is provided so that the engines for the jet propulsion units cannot be started unless the reverse thrust buckets are in their neutral positions and a detent mechanism is provided for holding the pedals and the reverse thrust bucket in this neutral condition.

13 Claims, 9 Drawing Sheets

CONTROL FOR JET POWERED WATERCRAFT

"This application is a continuation of application Ser. No. 07/977,127, filed Nov. 16, 1992, now abandoned.

BACKGROUND OF THE INVENTION

This invention relates to a control for a jet powered watercraft and more particularly to an improved control for the reverse thrust bucket of such a watercraft.

Jet propulsion type units are very popular for powering watercraft. They have a number of advantages which make them particularly desirable. In conjunction with the use of jet propulsion units, it is frequently the practice to provide a reverse thrust bucket which is moveable to a position cooperating with the discharge nozzle of the jet propulsion unit so as to redirect the water and to permit operation of the watercraft in a reverse direction. In fact, this reverse thrust bucket may also be employed as a device for breaking the forward speed of a watercraft. Furthermore, if the watercraft is powered by a pair of jet propulsion units, the operation of the reverse thrust bucket of one of the jet propulsion units can be utilized to achieve a sharper or more abrupt change in the direction of forward travel.

It is the normal practice to provide a form of control lever for the reverse thrust bucket for its operation. However, there are a number of disadvantages to such lever controls.

It is, therefore, a principal object to this invention to provide an improved foot operated control for the reverse thrust bucket of a jet propelled watercraft.

It is a further object to this invention to provide an improved pedal operator for the reverse thrust bucket of a jet propulsion unit for a watercraft.

In addition to providing forward and reverse operation, many jet propulsion units have their reverse thrust buckets configured so that they also can provide a neutral operation. In such an operation, the water is discharged from the discharge nozzle in a generally downward or upward direction so that no forward or reverse thrust is generated. It is desirable, at times, to insure that the operator has an easy way of determining the neutral position and placing the reverse thrust bucket in that position.

It is, therefore, a further object to this invention to provide an improved detent mechanism for holding a reverse thrust bucket in a neutral position.

It is a further object to this invention to provide an improved reverse thrust bucket operator having an arrangement for holding the reverse thrust bucket in its neutral position.

With a watercraft and particularly those having jet propulsion units, if the powering internal combustion engine is started, the watercraft may change its status rather abruptly. For example, if the watercraft is operating so that the reverse thrust bucket is in either a forward or reverse position and the engine is started, the occupants of the watercraft may be suddenly displaced.

It is, therefore, a still further object to this invention to provide an improved control for a jet propelled watercraft that will insure against starting of the engine unless the jet propulsion unit is in a neutral condition.

SUMMARY OF THE INVENTION

A first feature of this invention is adapted to be embodied in a jet propulsion system for a watercraft having a discharge nozzle for discharging water under pressure for propelling the watercraft. A reverse thrust bucket is positioned contiguous to the discharge nozzle for movement between a forward position wherein the discharge nozzle exerts a forward thrust on the watercraft and reverse position wherein the discharge nozzle and reverse thrust bucket generate a reverse thrust on the watercraft. A pedal is positioned in the watercraft positioned for operation by an operator's foot. Means are providing for connecting the pedal to the reverse thrust bucket for movement between its positions.

Another feature of the invention is also adapted to be embodied in a jet propulsion unit for a watercraft having a different discharge nozzle and a reverse thrust bucket that is moveable between a forward thrust position in which a forward thrust is generated, a neutral position wherein neither forward nor reverse thrusts are generated and a reverse thrust position wherein a reverse thrust is generated. A control is positioned in the watercraft in a position to be operated by an operator and is moveable between a forward position, a neutral position and a reverse position. Actuating means connect the control to the reverse thrust bucket for moving it between its positions in response to movement of the control between its positions. In accordance with this feature of the invention, detent means are provided for holding the control in a neutral position.

Another feature of the invention is adapted to be embodied in a jet propulsion system for a watercraft having a discharge nozzle for discharging water under pressure for propelling the watercraft and a thrust bucket moveable between a forward thrust position and a neutral thrust position. In the neutral thrust position, the jet propulsion unit does not provide any driving thrusts to the watercraft. A powering internal combustion engine is provided for driving the jet propulsion unit and means are provided for starting the engine. In accordance with this feature of the invention, means are provided for preventing starting of the engine by its starter unless the thrust bucket is in its neutral position.

DETAILED DESCRIPTION OF TEE PREFERRED EMBODIMENTS OF THE INVENTION

Figure 1:
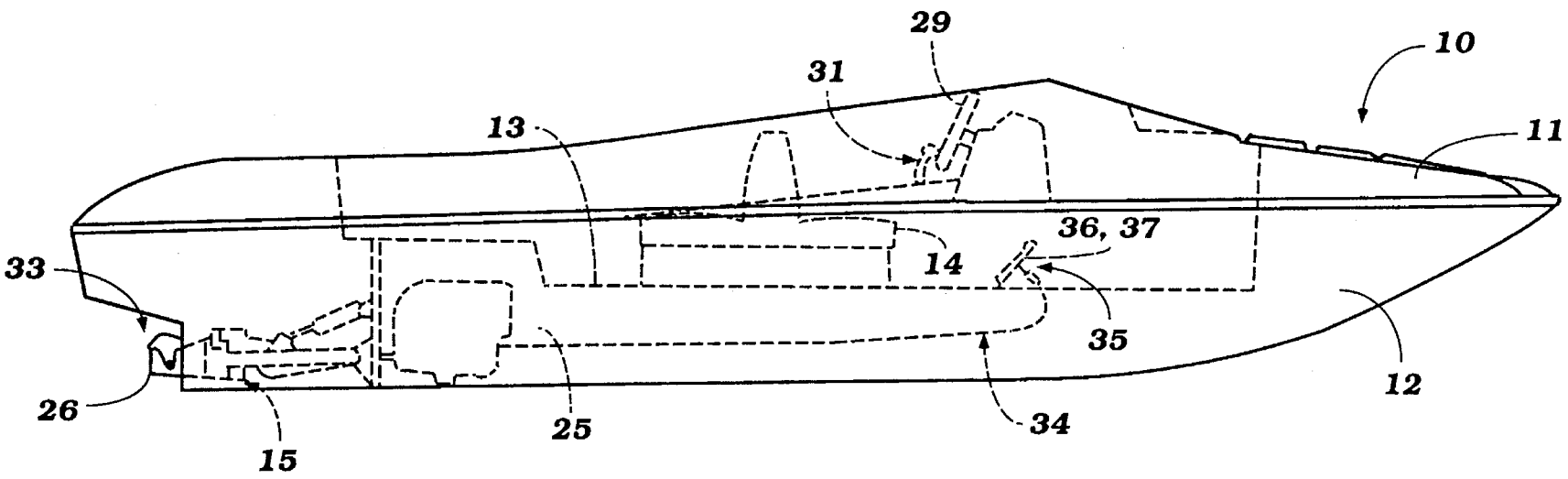
FIG. 1 is a side elevational view of a watercraft constructed in accordance with an embodiment of the invention.
Figure 2:
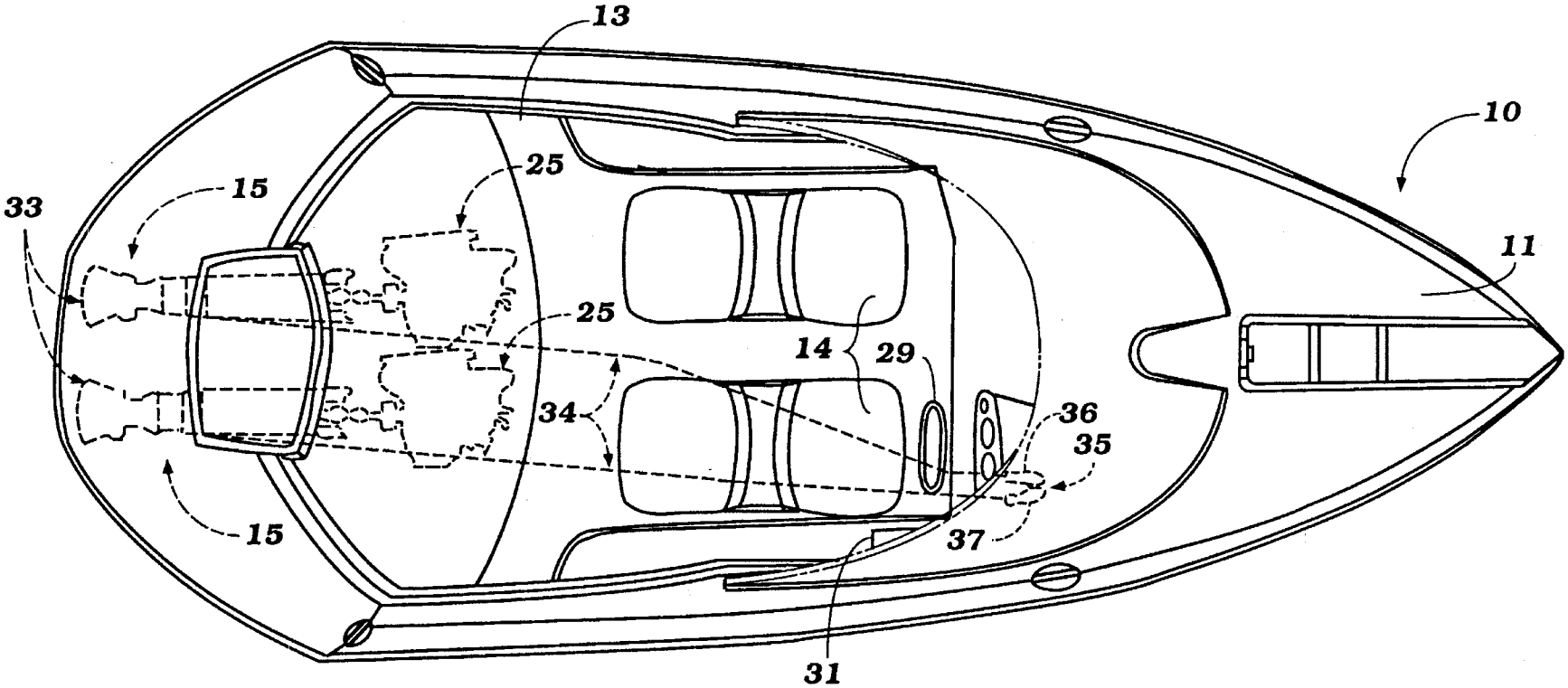
FIG. 2 is a top plan view of the watercraft.

Referring first in detail to FIGS. 1 and 2, a watercraft constructed in accordance with an embodiment of the invention is identified generally by the reference numeral 10. The watercraft 10 is comprised of a hull having an upper deck portion 11 and a lower hullportion 12. The deck and hull portions 11 and 12 may be formed from a suitable material such as a molded fiberglass reinforced plastic.

There is provided within the watercraft 10 a rider's area 13 having a pair of side by side seats 14 which have both forward and rearwardly facing portions. One of the seats, the right hand side seat in the drawings, is adapted to accommodate an operator and various controls, to be described, are provided in proximity to this operator's seat.

Figure 3:
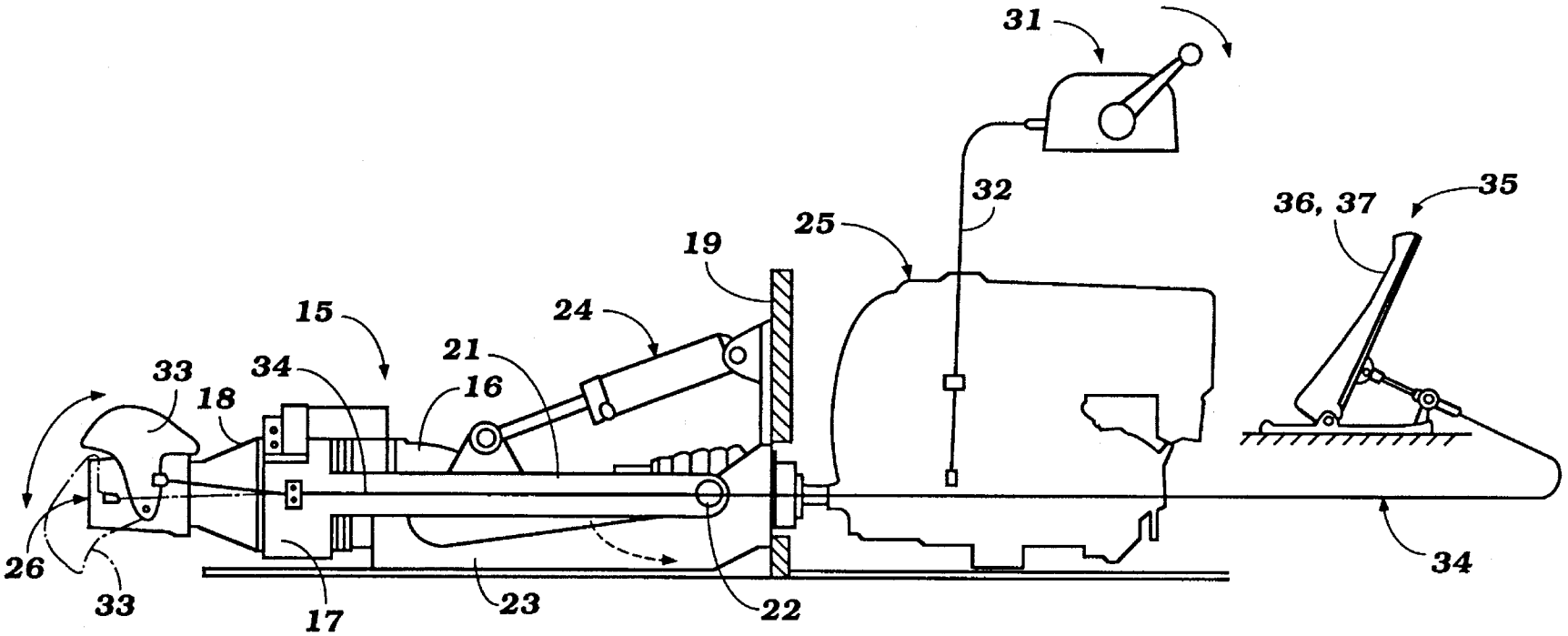
FIG. 3 is a side elevational view showing the controls associated with one of the jet propulsion units of the watercraft.
Figure 4:
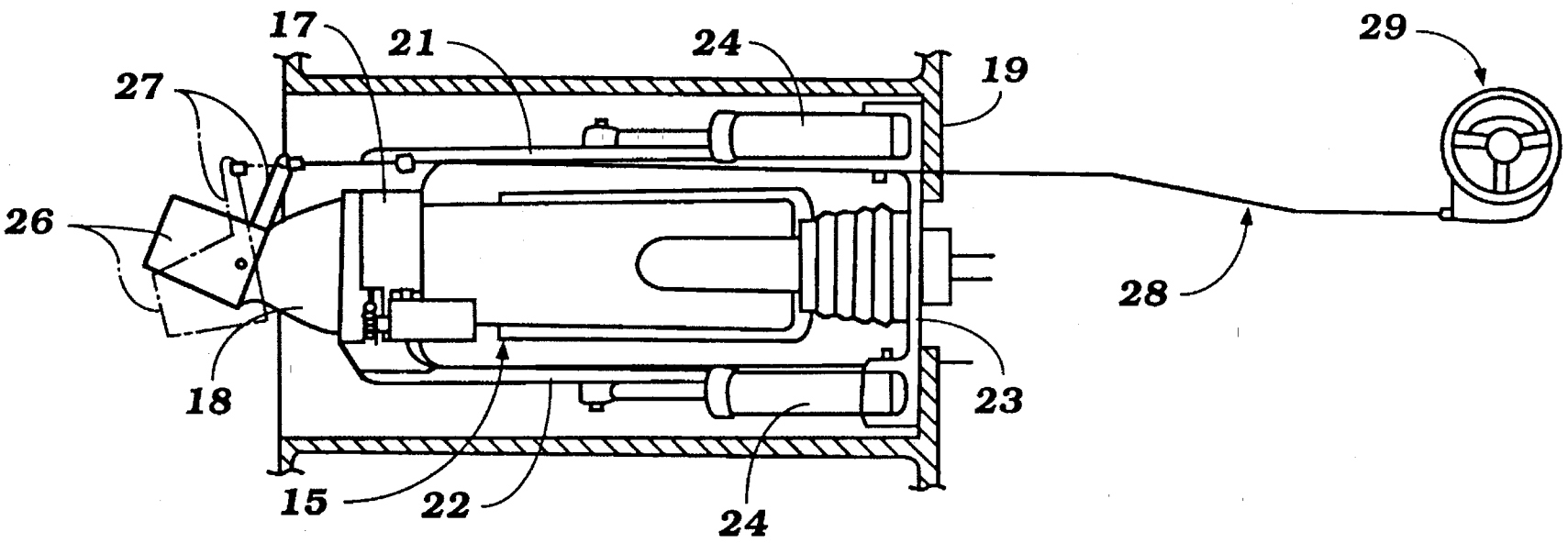
FIG. 4 is a top plan view, on reduced scale, of the construction shown in FIG. 3 and shows the steering control.
Figure 5:
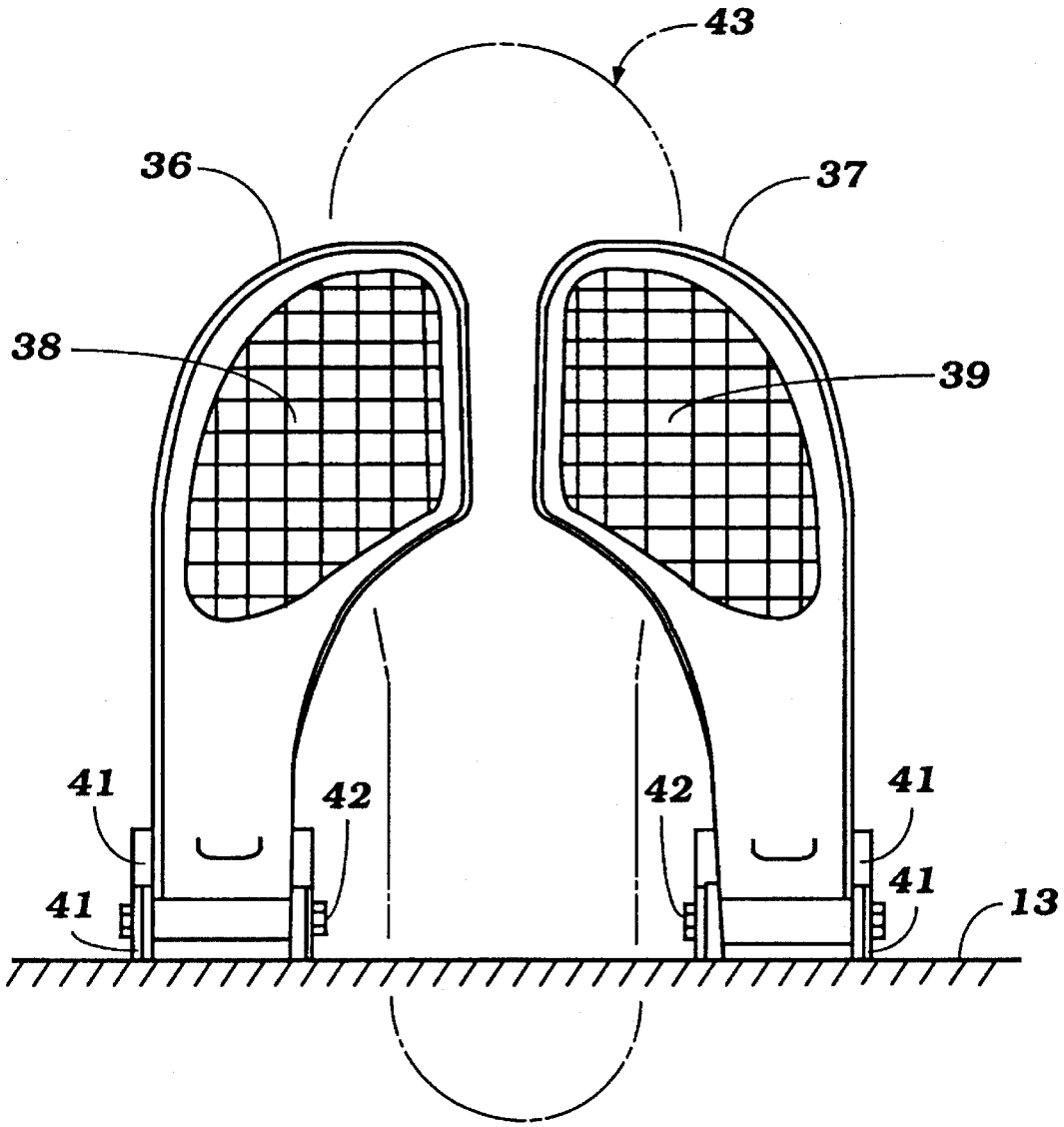
FIG. 5 is an enlarged rear elevational view showing the pedal operators for the reverse thrust bucket.

The rear end of the watercraft 10 and particularly to the lower hull portion 12 is provided with a tunnel in which a pair of jet propulsion units, each indicated generally by the reference numeral 15 are positioned. The jet propulsion units 15, each have a construction as best shown in FIGS. 3 and 4 and which may be of the general type as shown in either U.S. Pat. No. 5,151,057 on Sep. 29, 1992 or the co-pending application entitled "Water Jet Propulsion Boat", Ser. No. 680,709, filed Apr. 4, 1991, which are assigned to the Assignee hereof. In the illustrated embodiments, jet propulsion units of the type depicted in application Ser. No. 680,709 are employed and the disclosure of that application is incorporated herein by reference.

Generally these jet propulsion units are comprised of a water inlet portion 16 that has a normally downwardly facing water inlet opening through which water may be drawn, an impeller housing 17 containing an impeller and which draws the water under the driving power, as will be described, and a discharge nozzle 18 through which the water is discharged. The assemblage is mounted relative to a bulkhead 19 formed at the forward end of the tunnel by means of a pair of support arms 21 having forward pivotal connections 22 to a mounting cradle assembly 23. A pair of hydraulically operated cylinders 24 are pivotally connected to the cradle assembly 23 and the arms 22 for pivoting the jet propulsion units 15 between a lowered driving position and a raised service position.

In addition, the water inlet portion 16 is rotatably journaled relative to the impeller portion 17 so that it can be rotated to an upwardly facing position. This construction permits both servicing of the jet propulsion units 15 while they are mounted within the hull and also provides that the water may be drained out of the jet propulsion units 15 when the watercraft is not being operated so as to preclude incrustation. The other details of the jet propulsion units are not believed to be necessary to understand the construction and operation of the invention and, in fact, the invention may be utilized with a wide variety of different types of jet propulsion units and, for that reason, further description of the jet propulsion units 15, except for their steering and thrust control, will not be made.

Internal combustion engines 25 are mounted within the hull forward of the bulkhead 19 and have their output shafts coupled to the impeller shafts of the jet propulsion units 15 for driving them in a manner described in aforenoted co-pending application or patent. This drive includes a universal joint which accommodates the pivotal movement about the axis defined by the pivot pins 22.

Steering nozzles 26 are pivotally supported about vertically extending steering axes at the ends of the discharge nozzles 18 of each of the jet propulsion units 15. These steering nozzles 26 have a steering lever 27 affixed to one side thereof which is connected by means of a bowden wire actuator 28 to a steering wheel 29 positioned ahead of the operator's seat 14. As is well know, steering of the steering wheel 29 will rotate the positions of the steering nozzles 26 and cause the steering of the watercraft 10.

In addition to the steering control, a throttle control 31 is positioned at one side of the operator's seat 14 and is also connected by means of a bowden wire actuator 32 to the throttle control 31 of the engines 25.

A reverse thrust bucket, indicated generally by the reference numeral 33 and having any known type of construction is mounted on each of the steering nozzles 26 and is pivotally moveable between a forward thrust position, as shown in solid line views in the figures, a reverse thrust position as shown in phantom in FIG. 3 wherein a reverse thrust will be generated by the jet propulsion units 15 on the watercraft 10 and a neutral position wherein the water from the discharge nozzle 18 and steering nozzle 26 is directed generally downwardly so that there will be no forward or reverse driving thrusts.

Each reverse thrust bucket 33 has connected to it a bowden wire actuator 34 for moving it between its positions in response to the operation of a respective control pedal assembly constructed in accordance with an embodiment of the invention and which will now be described by particular reference to Figures 5 through 9. This control pedal assembly is indicated generally by the reference numeral 35.

The control pedal assembly 35 is comprised of a pair of pedals 36 and 37 which have foot engaging portions 38 and 39 that extend toward each other. Mounting brackets 41 are affixed to the floor of the rider's area 13 in front of the operator's seat 14. These mounting brackets 41 pivotally support the pedals 36 and 37, respectively by means of pivot means 42. As may be clearly seen in FIG. 5, the foot engaging portions 38 and 39 are disposed so that they both can be operated by a single foot 43 of an operator seated on the seat 14. Alternatively, either pedal 36 or 37 may be operated independently of the other. The reasons and advantages for this will become apparent.

Figure 6:
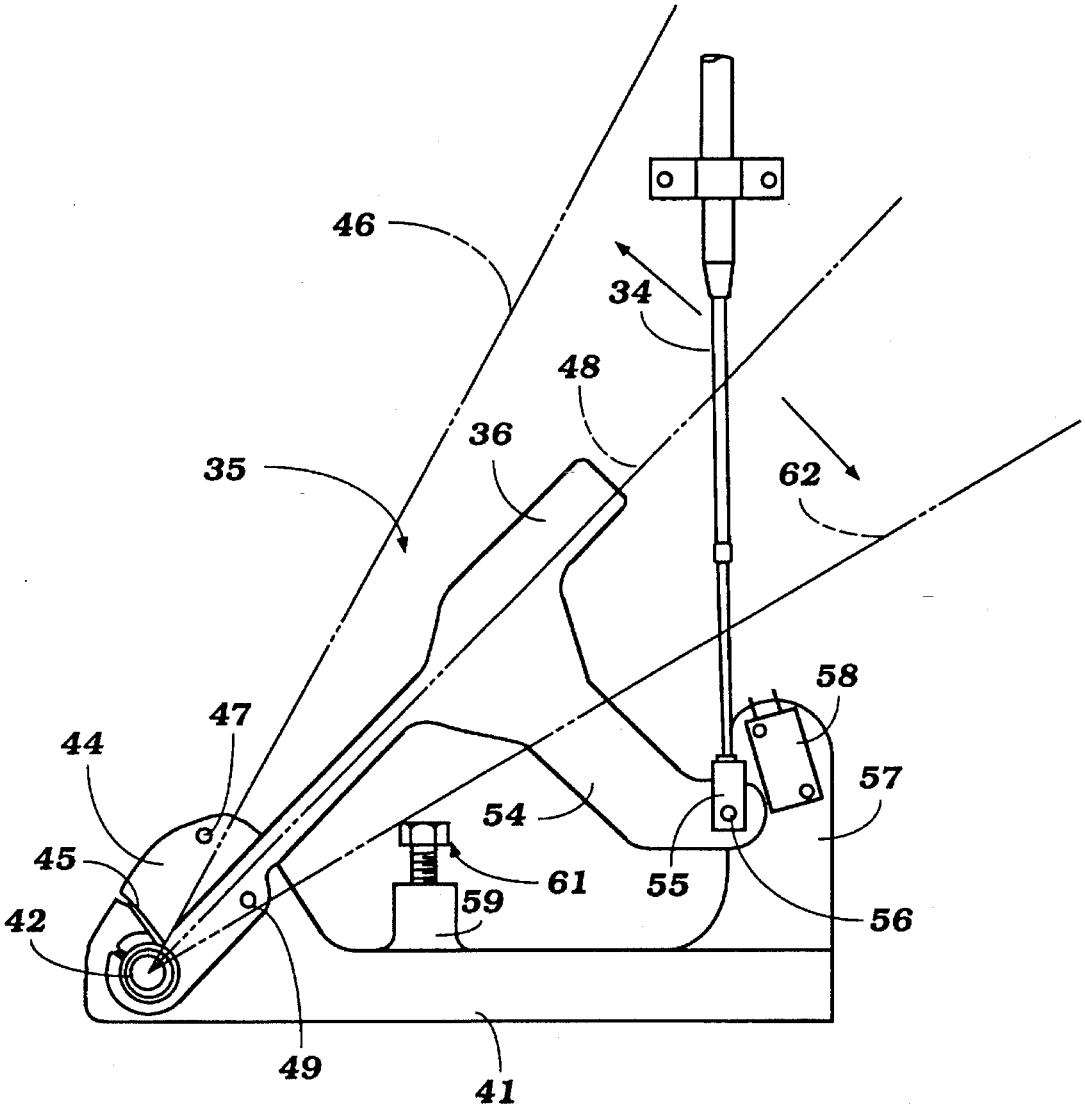
FIG. 6 is a side elevational view of one of the pedal operators showing this operator in the neutral position.
Figure 7:
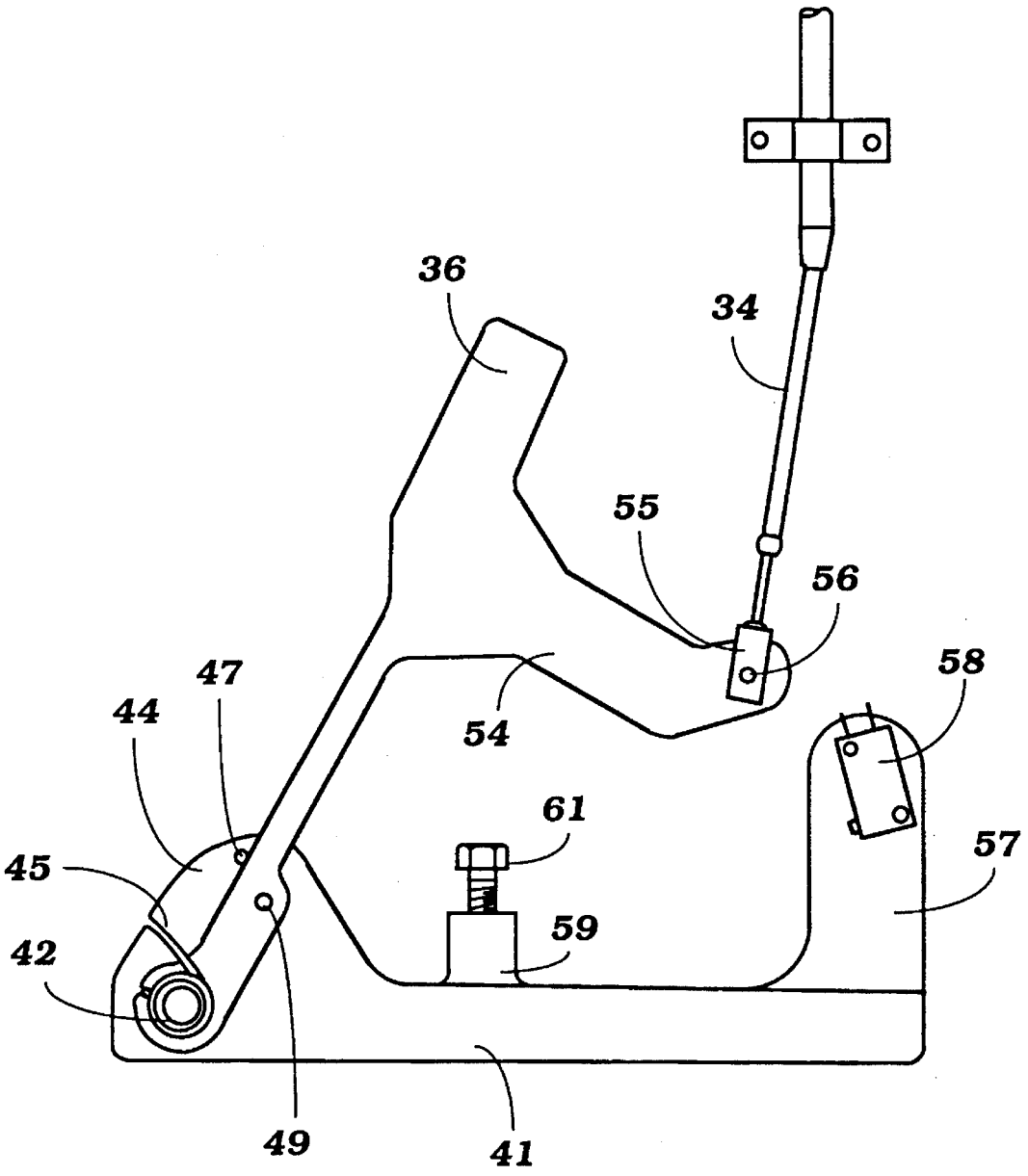
FIG. 7 is a side elevational view, in part similar to FIG. 6, and shows the pedal operator in the forward position.

As may be best seen in FIGS. 6 through 9, the mounting brackets 41 have upstanding portions 44 through which the pivot pins 42 extend. Torsional mouse trap type springs 45 are loaded between these portions 44 and the pedals 36 and 37 for normally urging the pedals a forward thrust position along the line 46 as shown in FIG. 6 and in the position shown in FIG. 7. In this position, the reverse thrust buckets 33 are in their forward drive positions. A stop pin 47 is mounted in one of the side portions 44 and engages the pedal 36 or 37 to limit the degree of movement in this direction.

The pedals 36 and 37 may be pivoted downwardly to a neutral drive position as shown by the line 48 wherein the reverse thrust buckets 33 are in their aforedescribed neutral positions. A detent mechanism is provided for retaining these pedals 36 and 37 in this neutral position and this detent mechanism includes a detent recess 49 formed in the side of the pedals 36 and 37 and a detent ball 51 that is received in a bore 52 of one of the portions 44 of the mounting brackets 41 and which is urged into engagement with the detent recess 49 by a coil compression spring 53. Hence, when the operator moves the pedals 36 and 37 to the neutral position as shown in FIG. 6, the reverse thrust bucket 33 will be held in this neutral position.

It should be noted that the pedals 36 and 37 have arm portions 54 to which the bowden wire actuators 34 are connected by means of a trunnion 55 and pivot pin 56. Adjacent these arm portions 54, the mounting bracket 41 has an upstanding portion 57 that carries a neutral detector switch 58 which is contacted by the arm portion 54 when the pedals 36 and 37 are in their neutral position. This neutral detector switch 58 is wired into the starting circuit for electric starters for the engines 25 so that the engines 25 cannot be started until both pedals 36 and 37 have been moved to their neutral position. This assures that when the engines 25 are started, no driving thrust will be exerted on the watercraft 10 that could upset the operator or passengers.

Figure 8:
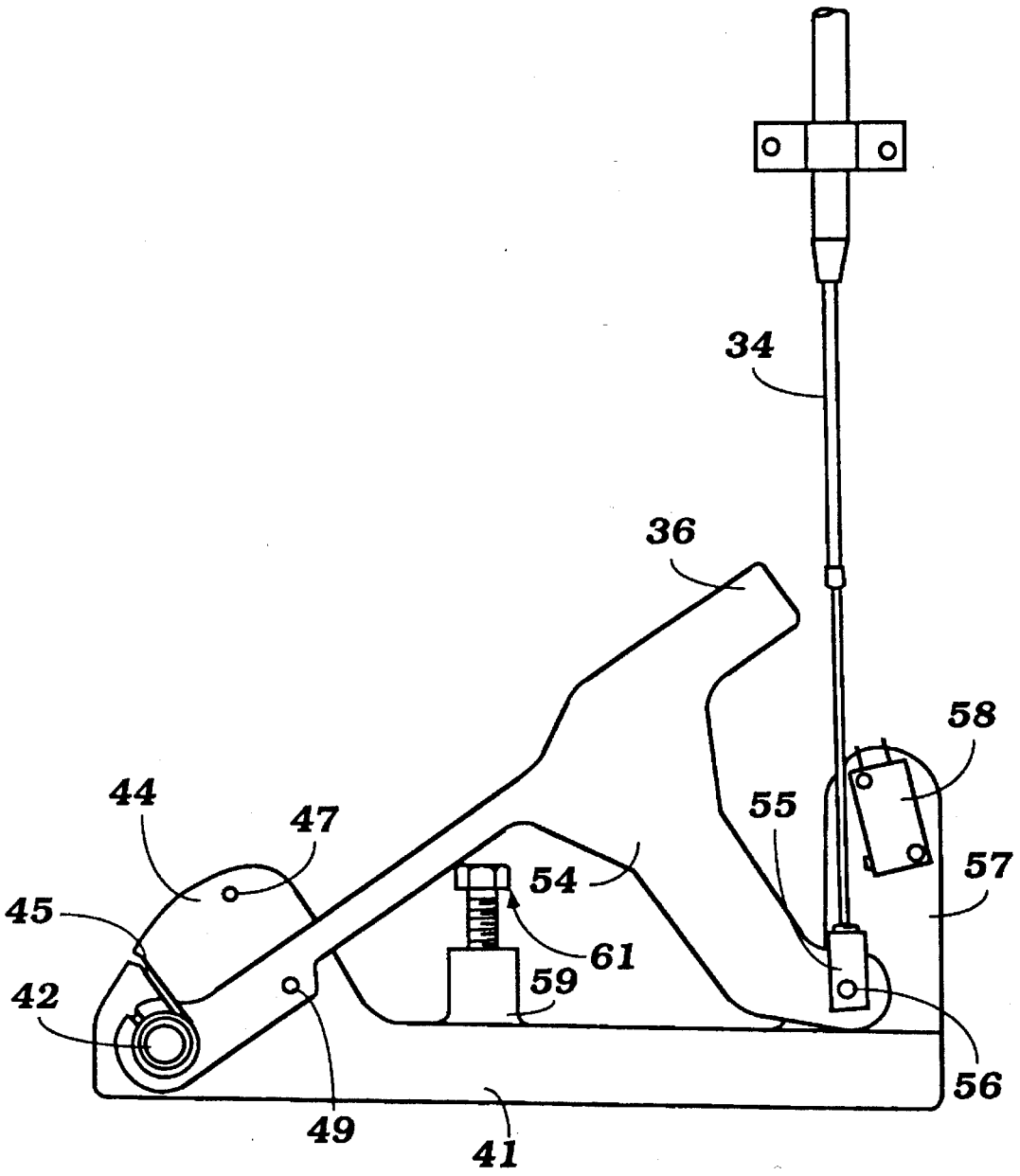
FIG. 8 is a side elevational view, in part similar to FIGS. 6 and 7, and shows the pedal operator in the reverse position.
Figure 9:
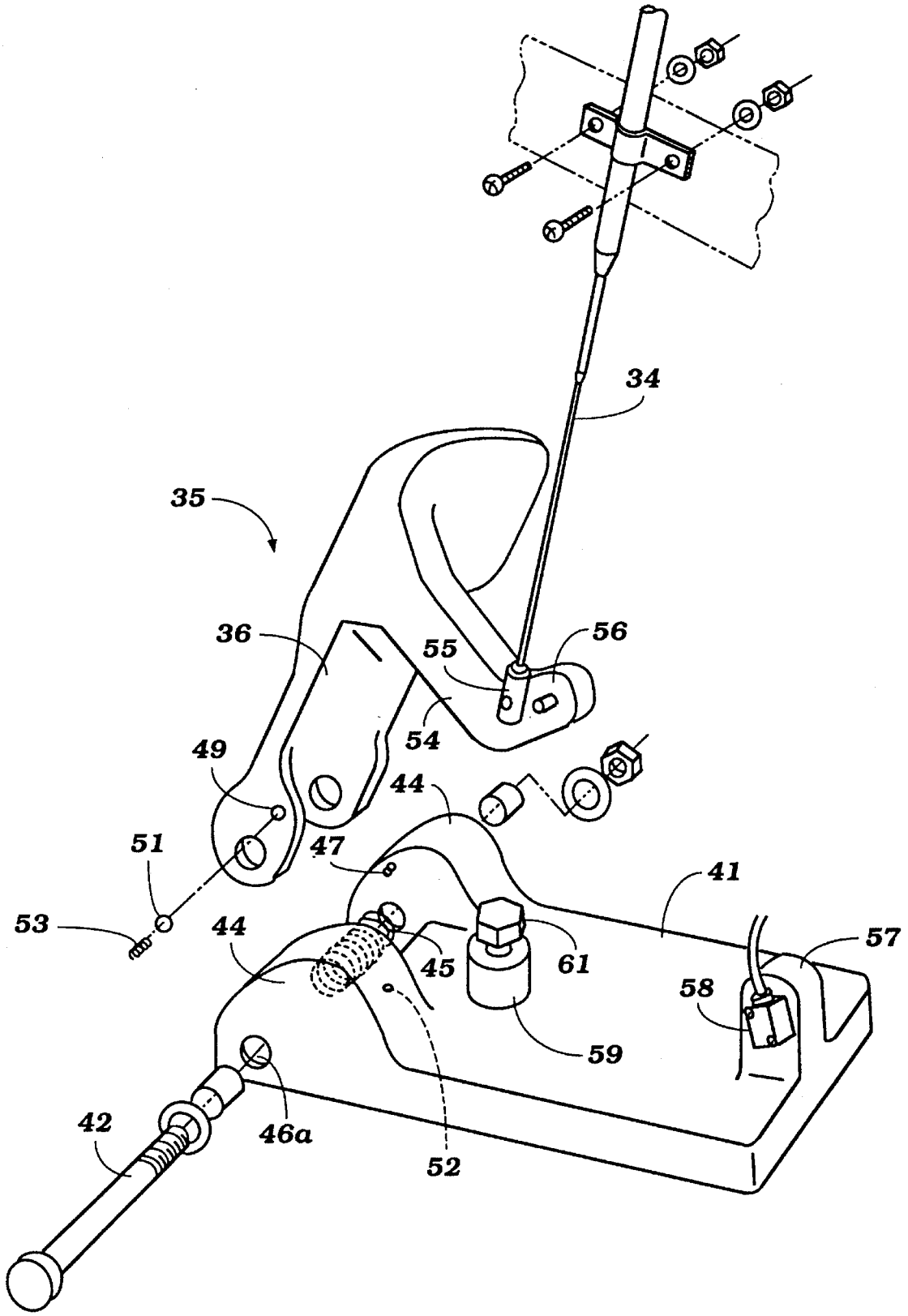
FIG. 9 is an exploded perspective view of the pedal operator.

The mounting bracket 41 is also formed with an upstanding boss 59 in which an adjustable screw 61 is positioned and which screw 61 is adapted to be engaged by the underside of the pedals 36 and 37 when they are depressed fully downwardly to the position shown by the phantom line 62 in FIG. 6 and the position show in FIG. 8. This constitutes the reverse thrust position and that is adjusted by the position of the screw 61.

It is to be understood that the pedals 36 and 37 may be both actuated simultaneously to the reverse thrust position of Figure 8 so as to achieve a sudden braking force on the forward motion of the watercraft 10 and also so as to provide a reverse thrust, if desired. Thus, ready stopping and reverse operation of both jet propulsion units 15 may be achieved simultaneously.

It may also be possible to create an abrupt turning motion by operating the reverse thrust bucket 33 associated with only one of the jet propulsion units 15 and to achieve this the operator can apply foot pressure only to the pedal 36 or the pedal 37 so as to achieve an abrupt change in steering direction.

It should be readily apparent that the aforedescribed construction permits very easy operation of the watercraft and the reverse thrust buckets without necessitating hand control. In addition, either or both reverse thrust bucket control pedals may by operated at the same time and starting of the engine when the reverse thrust buckets are not in their neutral position can be avoided. Of course, the foregoing description is that of preferred embodiments of the invention and various changes and modifications may be made without departing from the spirit and scope of the invention, as defined by the appended claims.

We claim:

1. A jet propulsion system for a watercraft having a discharge nozzle for discharging water under pressure for propelling the watercraft, a reverse thrust bucket positioned contiguous to said discharge nozzle and supported for movement between a forward thrust position wherein a forward thrust is exerted on the watercraft and a reverse thrust position wherein a reverse thrust is exerted on the watercraft, a pedal positioned in the watercraft in a position for operation by an operator's foot and moveable between an extending forward drive position and a depressed reverse drive position upon an operator depressing said pedal with the operator's foot, means for connecting said pedal only to said reverse thrust bucket for operating said reverse thrust bucket between its positions in response to movement of said pedal and means for biasing said system for maintaining said reverse thrust bucket and said pedal normally to their forward thrust positions for maintaining a forward drive when no foot pressure is applied to depress said pedal.

2. A jet propulsion system for a watercraft as set fourth in claim 1 wherein the pedal is pivotally supported between the extending forward drive position and the depressed reverse drive position.

3. A jet propulsion system for a watercraft as set forth in claim 2 wherein the reverse thrust bucket is also moveable to a neutral position wherein no driving thrust is exerted on the watercraft and the pedal has a neutral position depressed between the extending forward and a fully depressed reverse position for positioning the reverse thrust bucket in its neutral position.

4. A jet propulsion system for a watercraft as set fourth in claim 3 further including a detent for retaining said pedal in its neutral position.

5. A jet propulsion system for a watercraft as set forth in claim 3 further including an internal combustion engine for powering the watercraft, means for starting said internal combustion engine, and means for precluding starting of said engine by said starting means unless said pedal is in its neutral position.

6. A jet propulsion system for a watercraft a set forth in claim 5 further including a detent for retaining said pedal in its neutral position.

7. A jet propulsion system for a watercraft as set forth in claim 1 wherein there are a pair of jet propulsion units each having a respective discharge nozzle and reverse thrust bucket and further including a pair of pedals, each for operating the respective reverse thrust bucket of the respective jet propulsion unit.

8. A jet propulsion system for a watercraft as set forth in claim 7 wherein the pedals are positioned so that an operator may operate both of the pedals with a single foot or may operate either pedal independently of the other.

9. A jet propulsion system for a watercraft as set forth in claim 8 wherein the pedals are pivotally supported between the forward drive position and the reverse drive position.

10. A jet propulsion system for a watercraft as set forth in claim 9 wherein the reverse thrust buckets are also moveable to a neutral position wherein no driving thrust is exerted on the watercraft and the pedals have a neutral position between the forward and reverse positions for positioning the reverse thrust bucket in its neutral position.

11. A jet propulsion system for a watercraft as set forth in claim 10 further including a detent for retaining said pedals in their neutral positions.

12. A jet propulsion system for a watercraft as set forth in claim 10 further including an internal combustion engine for powering the watercraft, means for starting said internal combustion engine, and means for precluding starting of said engines by said starting means unless said pedals are in their neutral positions.

13. A jet propulsion system for a watercraft as set forth in claim 12 further including a detent for retaining said pedals in their neutral positions.

* * * * *